US009726045B2

(12) United States Patent
Kondo et al.

(10) Patent No.: US 9,726,045 B2
(45) Date of Patent: Aug. 8, 2017

(54) TURBINE EXTERNAL COMPARTMENT, FRAME FOR TURBINE EXTERNAL COMPARTMENT, AND METHOD OF CONSTRUCTING FRAME FOR TURBINE EXTERNAL COMPARTMENT

(75) Inventors: Makoto Kondo, Minato-ku (JP); Tamiaki Nakazawa, Minato-ku (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 1048 days.

(21) Appl. No.: 13/876,027

(22) PCT Filed: Dec. 21, 2011

(86) PCT No.: PCT/JP2011/079659
§ 371 (c)(1),
(2), (4) Date: Mar. 26, 2013

(87) PCT Pub. No.: WO2012/098804
PCT Pub. Date: Jul. 26, 2012

(65) Prior Publication Data

US 2013/0177443 A1 Jul. 11, 2013

(30) Foreign Application Priority Data

Jan. 19, 2011 (JP) ..... 2011-009238

(51) Int. Cl.
*F01D 25/28* (2006.01)
*F01D 25/24* (2006.01)

(52) U.S. Cl.
CPC ..... *F01D 25/28* (2013.01); *F01D 25/24* (2013.01); *F05D 2220/31* (2013.01);
(Continued)

(58) Field of Classification Search
CPC ..... F01D 25/24; F01D 25/28; F05D 2220/31; F05D 2230/54; F05D 2300/171
See application file for complete search history.

(56) References Cited

U.S. PATENT DOCUMENTS 3,942,907 A 3/1976 Meylan
4,682,754 A 7/1987 Ebata et al.
(Continued)

FOREIGN PATENT DOCUMENTS

EP 0 751 283 1/1997
EP 1 826 365 8/2007
(Continued)

OTHER PUBLICATIONS

Decision to Grant a Patent issued May 19, 2015 in corresponding Japanese patent application No. 2011-009238 (with English translation).
(Continued)

*Primary Examiner* — Phutthiwat Wongwian
*Assistant Examiner* — Diem Tran
(74) *Attorney, Agent, or Firm* — Wenderoth, Lind & Ponack, L.L.P.

(57) ABSTRACT

An object of the present invention is to provide a turbine external compartment, a frame for a turbine external compartment, and a method of constructing a frame for a turbine external compartment that can improve a flow of steam inside of the compartment and can enhance the rigidity of the compartment using a simple structure. A turbine external compartment according to the present invention is placed in a frame having a steel-plate reinforced concrete structure obtained by filling a space between a plurality of steel plates with concrete. The turbine external compartment includes a lower half part having a side plate part or an end plate part made of the steel plates that constitute the frame.

2 Claims, 11 Drawing Sheets

(52) U.S. Cl.
CPC .... *F05D 2230/54* (2013.01); *F05D 2300/171* (2013.01); *Y10T 29/49616* (2015.01)

(56) References Cited

U.S. PATENT DOCUMENTS

| | | | | |
|---|---|---|---|---|
| 5,779,435 | A * | 7/1998 | Lageder et al. | F01D 25/24 184/106 |
| 2007/0189893 | A1 | 8/2007 | Burdgick | |

FOREIGN PATENT DOCUMENTS

| | | |
|---|---|---|
| JP | 52-57412 | 5/1977 |
| JP | 59-38402 | 9/1984 |
| JP | 63-289398 | 11/1988 |
| JP | 9-13913 | 1/1997 |
| JP | 10-311049 | 11/1998 |
| JP | 11-93616 | 4/1999 |
| JP | 2001-3708 | 1/2001 |
| JP | 2002-5386 | 1/2002 |
| JP | 2002-89207 | 3/2002 |
| JP | 2002-235505 | 8/2002 |
| JP | 3764557 | 4/2006 |
| JP | 2007-218259 | 8/2007 |
| JP | 2008-50957 | 3/2008 |
| JP | 4241867 | 3/2009 |
| JP | 4358408 | 11/2009 |

OTHER PUBLICATIONS

Decision to Grant a Patent issued May 19, 2015 in corresponding Japanese patent application No. 2014-032777.
Office Action issued Jun. 20, 2014 in corresponding Chinese patent application No. 201180047264.7 (with English translation).
International Search Report issued Feb. 7, 2012 in International Application No. PCT/JP2011/079659.
Partial English Translation of Written Opinion of the International Searching Authority issued Feb. 7, 2012 in International Application No. PCT/JP2011/079659.
Notice of Allowance issued on Mar. 18, 2015 in corresponding Chinese patent application No. 201180047264.7.
Notice of Allowance issued Apr. 24, 2015 in corresponding Korean patent application No. 2013-7004823.

* cited by examiner

TURBINE EXTERNAL COMPARTMENT, FRAME FOR TURBINE EXTERNAL COMPARTMENT, AND METHOD OF CONSTRUCTING FRAME FOR TURBINE EXTERNAL COMPARTMENT

BACKGROUND OF THE INVENTION

1. Technical Field

The present invention relates to a turbine external compartment, a frame for a turbine external compartment, and a method of constructing a frame for a turbine external compartment.

2. Description of the Related Art

In a steam turbine power generation system, a high-pressure turbine, a low-pressure turbine, a generator, and the like are installed in a frame and are fixed thereto. The frame has, for example, a reinforced concrete structure or a steel-plate reinforced concrete structure obtained by filling the inside of a steel plate with concrete. Openings are provided in an upper part of the frame, and lower half parts of the apparatuses are housed in the openings, respectively.

FIG. 8 illustrates an example of a frame 80 according to the related art. In FIG. 8, a high-pressure turbine is housed in the opening HP, low-pressure turbines are respectively housed in the openings LP-1 and LP-2, and a generator is housed in the opening GEN. In the case of the low-pressure turbine, a lower half part 50 of a turbine external compartment thereof is housed in the opening, and an upper half part 51 of the external compartment covers a portion above the lower half part 50. The Y-directional length of the lower half part 50 is, for example, approximately 10 m.

Japanese Examined Patent Application, Publication No. S59-38402 discloses a technique of constructing a lower half part of a turbine low-pressure casing integrally with a frame having a reinforced concrete structure. Further, Japanese Patent No. 4358408 discloses a frame for a power generation facility in which a plurality of beams, each having a steel-plate reinforced concrete structure, are supported by a plurality of pillars each having a concrete structure.

SUMMARY OF THE INVENTION

1. Technical Problem

Meanwhile, in the low-pressure turbine, steam is discharged into a condenser, and the inside of the compartment thereof is kept at a pressure equal to or less than an atmospheric pressure. Hence, the compartment is provided with a reinforcement structure to prevent a deformation. FIG. 9 is a perspective view illustrating the lower half part of the turbine external compartment according to the related art. FIG. 10 is a longitudinal sectional view illustrating the lower half part of the turbine external compartment according to the related art, which is taken along line B-B in FIG. 11. FIG. 11 is a plan view illustrating the lower half part of the turbine external compartment according to the related art.

The lower half part 50 has a steel-plate outer wall formed of, for example, a side plate part 52 and an end plate part 53. A T-rib 54 having a T-shape in cross section is provided as an external reinforcement structure along the side plate part 52 and the end plate part 53. Further, an internal reinforcement rib 57 and a stay bar 58 are provided as an internal reinforcement structure in the lower half part 50.

However, in recent years, along with an increase in the size of turbines, it is becoming difficult to secure rigidity necessary for a compartment using the external reinforcement structure and the internal reinforcement structure according to the related art. That is, in the case where the lower half part 50 of the external compartment is installed in the frame 80, the lower half part 50 of the external compartment is supported by the frame 80 by means of a foot 55 with the intermediation of a frame plate 82. The foot 55 is a horizontal member that is provided so as to protrude from the side plate part 52 and the end plate part 53 of the lower half part 50 of the external compartment.

At this time, as illustrated in FIG. 11, a clearance is provided between the side plate part 52 of the lower half part 50 and a beam side surface 80*a* of the frame 80 and between the end plate part 53 of the lower half part 50 and a beam side surface 80*b* of the frame 80. If the clearance becomes excessively wide, the beam cross section of the turbine frame becomes large, that is, cost of the frame increases, and hence it is desirable that the clearance be narrow. Accordingly, it is not possible to enhance the rigidity of the compartment by increasing the size of the T-rib 54 as the external reinforcement structure.

Further, the internal reinforcement rib 57 and the stay bar 58 as the internal reinforcement structure hinder a flow of steam inside of the compartment, and thus cause a pressure loss. Accordingly, steam guided to the condenser may stagnate, and the discharge performance of the low-pressure turbine may decrease.

The present invention, which has been made in view of the above-mentioned circumstances, has an object of providing a turbine external compartment, a frame for a turbine external compartment, and a method of constructing a frame for a turbine external compartment that can improve a flow of steam inside of the compartment and can enhance the rigidity of the compartment using a simple structure.

2. Solution to the Problem

In order to solve the above-mentioned problems, a turbine external compartment, a frame for a turbine external compartment, and a method of constructing a frame for a turbine external compartment according to the present invention adopt the following solutions.

That is, a turbine external compartment according to a first aspect of the present invention is placed in a frame having a steel-plate reinforced concrete structure obtained by filling a space between a plurality of steel plates with concrete, the turbine external compartment includes a lower half part having a side plate part or an end plate part which includes the steel plates of the frame.

According to the turbine external compartment according to the first aspect of the present invention, the frame in which the turbine external compartment is placed has the steel-plate reinforced concrete structure obtained by filling the space between the plurality of steel plates with concrete, and the turbine external compartment includes the lower half part having the side plate part or the end plate part which includes the steel plates of the frame. Here, the side plate part or the end plate part of the turbine external compartment corresponds to, for example, the outer wall of the turbine external compartment, the side plate part may be a plate-like member parallel to the turbine axis direction, and the end plate part may be a plate-like member perpendicular to the turbine axis direction. Further, the side surfaces and the bottom surface of each beam portion of the frame are made of steel plates. Then, the side plate part or the end plate part of the turbine external compartment is used in common to the side plate of the beam portion of the frame, and thereby the frame doubles as a reinforcement member of the turbine external compartment. As a result, the reinforcement structure of the turbine external compartment can be reduced compared with the case where a turbine external compartment configured as an independent single structure is placed inside of the frame. Further, the frame has the steel-plate reinforced concrete structure, and hence formwork construction for concrete placement can be reduced compared with the case of a general reinforced concrete structure, so that the work period can be shortened.

The turbine external compartment according to the first aspect of the present invention may further include: a support member having an upper part that supports a turbine internal compartment; and an adjustment member provided on the support member, for adjusting a vertical position of the turbine internal compartment.

According to this configuration, the support member has the upper part that supports the turbine internal compartment, and the adjustment member is provided on the support member and thus can adjust the vertical position of the turbine internal compartment. The support member is connected to, for example, the side surface of the beam member of the frame. The turbine internal compartment is provided inside of the turbine external compartment. In general, the accuracy of dimension of the turbine external compartment having a steel-plate reinforced concrete structure is lower than the accuracy of dimension of the turbine internal compartment, and hence it is difficult to place the turbine internal compartment with high accuracy. On the other hand, as position adjustment is performed using the adjustment member, the turbine internal compartment can be placed with high accuracy.

Further, a frame for a turbine external compartment according to a second aspect of the present invention has a steel-plate reinforced concrete structure obtained by filling a space between a plurality of steel plates with concrete. The steel plates which are a side surface of a beam member of the frame are a side plate part or an end plate part, and the side plate part and the end plate part constitute a lower half part of the turbine external compartment.

In the frame for a turbine external compartment according to the second aspect of the present invention, the frame for a turbine external compartment has the steel-plate reinforced concrete structure obtained by filling the space between the plurality of steel plates with concrete. Then, the steel plates that each constitute the side surface of the beam member of the frame are the side plate part or the end plate part that constitutes a lower half part of the turbine external compartment, and thereby the frame doubles as a reinforcement member of the turbine external compartment. As a result, the reinforcement structure of the turbine external compartment can be reduced compared with the case where a turbine external compartment configured as an independent single structure is placed inside of the frame. Further, the frame has the steel-plate reinforced concrete structure, and hence formwork construction for concrete placement can be reduced compared with the case of a general reinforced concrete structure, so that the work period can be shortened.

Moreover, in a method of constructing a frame for a turbine external compartment according to a third aspect of the present invention, the frame has a steel-plate reinforced concrete structure obtained by filling a space between a plurality of steel plates with concrete, and the steel plates that each constitute a side surface of a beam member of the frame are a side plate part or an end plate part that constitutes a lower half part of the turbine external compartment. The method includes: constructing a first block and a second block, the first block including a first beam member having a side surface made of a steel plate, the second block including a second beam member having a side surface made of a steel plate, and a support member that is connected to the second beam member and has an upper part that supports a turbine internal compartment; and connecting the first block and the second block to each other.

In the method of constructing a frame for a turbine external compartment according to the third aspect of the present invention, the first block and the second block are first constructed at the time of constructing the frame for a turbine external compartment. The first block includes the first beam member that serves as the beam member of the frame, and the second block includes the second beam member that serves as the beam member of the frame, and the support member that is connected to the second beam member and has the upper part that supports the turbine internal compartment. Then, the first block and the second block are connected to each other, and thereby the frame for a turbine external compartment is configured. The frame for a turbine external compartment has the steel-plate reinforced concrete structure obtained by filling the space between the plurality of steel plates with concrete, and the steel plates that each constitute a side surface of the beam member are the side plate part or the end plate part that constitutes a lower half part of the turbine external compartment. For example, the first block and the second block are constructed in advance in a factory or the like, and are installed at the site. In this way, the accuracy of dimension of the turbine external compartment integrated with the beam members of the frame can be improved, and the construction period at the site can be shortened.

3. Advantageous Effects of the Invention

According to the present invention, it is possible to improve a flow of steam inside of the compartment and enhance the rigidity of the compartment using a simple structure.

DETAILED DESCRIPTION OF THE INVENTION

Hereinafter, an embodiment of the present invention is described with reference to the drawings.

Figure 1:
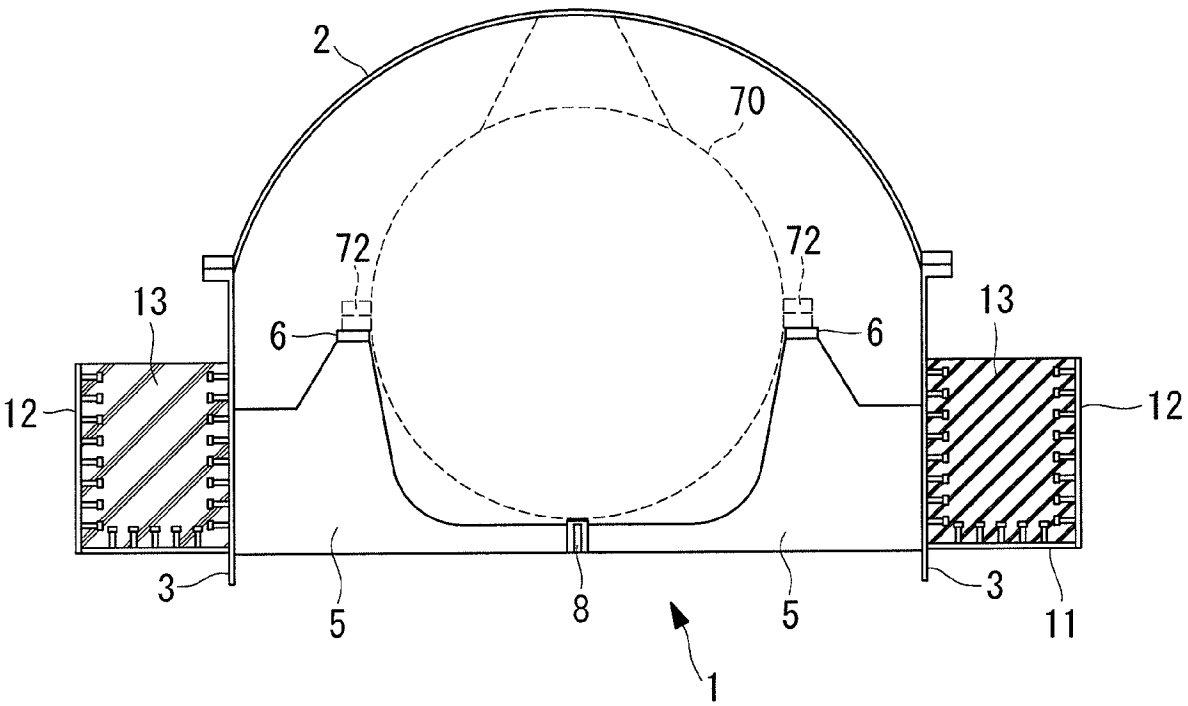
FIG. 1 is a longitudinal sectional view illustrating a frame and a turbine external compartment according to the present invention.
Figure 2:
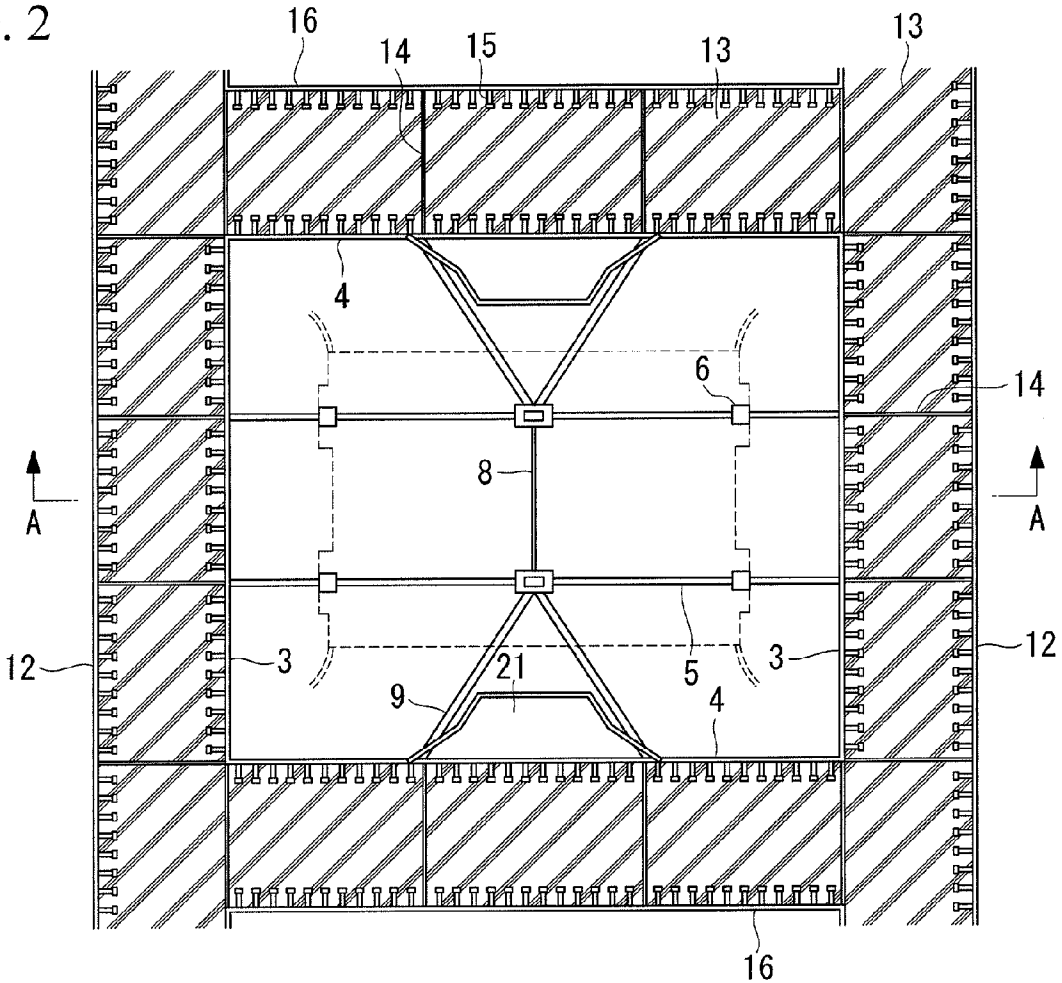
FIG. 2 is a plan view illustrating the frame and the turbine external compartment according to the present invention.

First, configurations of a frame and a turbine external compartment according to the embodiment of the present invention are described. FIG. 1 is a longitudinal sectional view illustrating a frame and a turbine external compartment according to the present invention. FIG. 2 is a plan view illustrating the frame and the turbine external compartment according to the present invention. Note that FIG. 1 is a sectional view taken along line A-A in FIG. 2.

Figure 8:
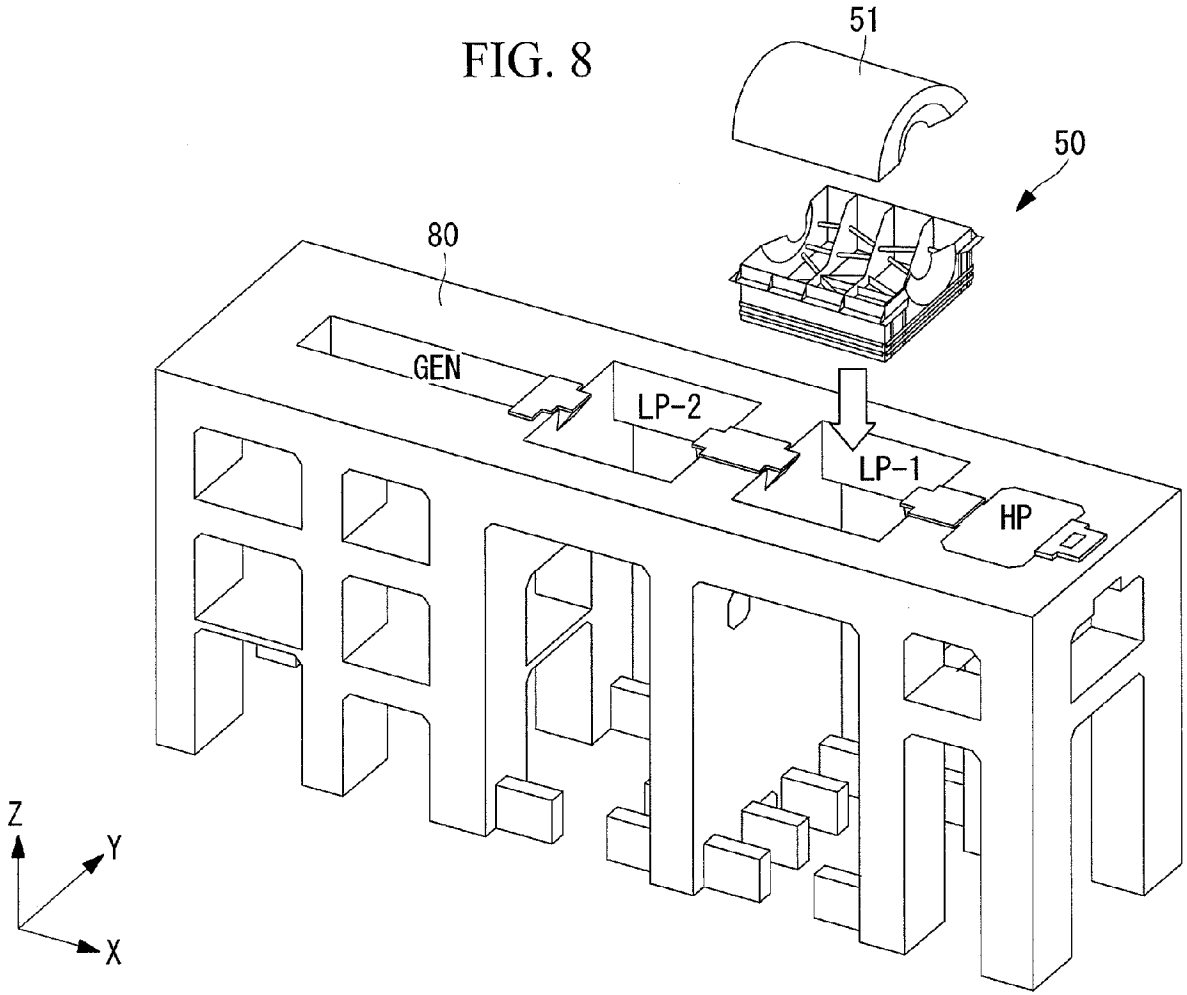
FIG. 8 is a perspective view illustrating a frame according to a related art.
Figure 9:
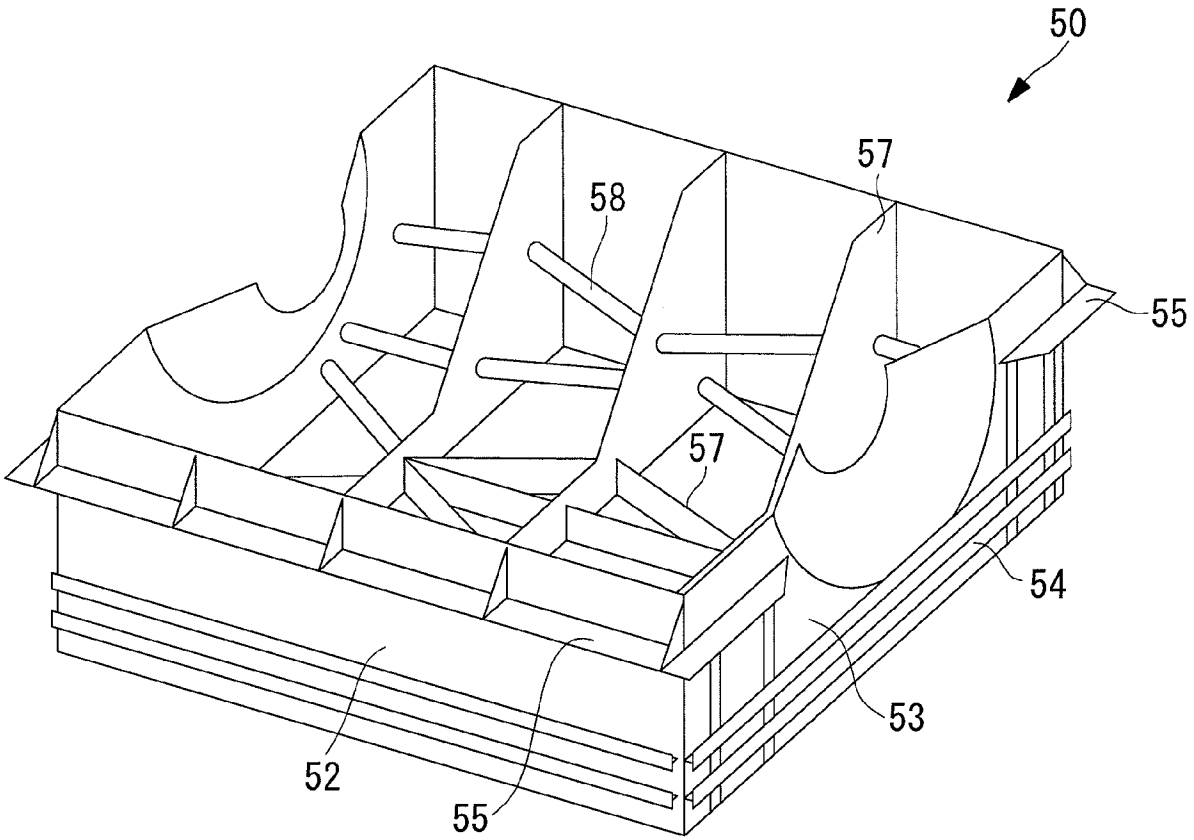
FIG. 9 is a perspective view illustrating a lower half part of a turbine external compartment according to the related art.
Figure 10:
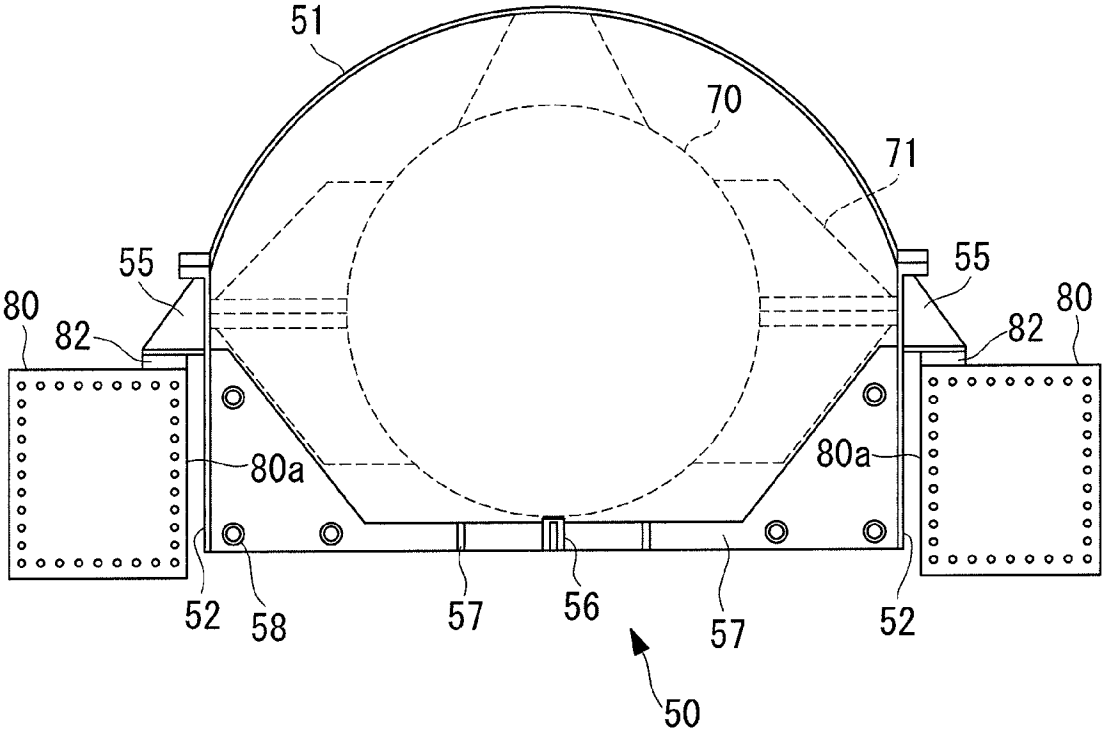
FIG. 10 is a longitudinal sectional view illustrating the frame and the lower half part of the turbine external compartment according to the related art.

The frame according to the present embodiment includes beams and pillars that support the beams similarly to the frame 80 according to the related art illustrated in FIG. 8. The frame houses and fixes a lower half part 1 of the turbine external compartment by means of an opening that is formed in an upper part of the frame while being surrounded by the beams. Note that a turbine built in the lower half part 1 is, for example, a low-pressure turbine in a steam turbine power generation system. An upper half part 2 of the external compartment covers a portion above the lower half part 1. At least the beams of the frame each have a steel-plate reinforced concrete structure obtained by filling the space between a plurality of steel plates with concrete 13.

The side surfaces and the bottom surface of each beam of the frame are made of steel plates. Then, as illustrated in FIG. 1, beams in one direction of the beams of the frame each include: a plate-like bottom surface part 11 that constitutes the bottom surface; a side plate part 3 that constitutes one side surface of the beam; and a plate-like side surface part 12 that is opposed to the side plate part 3 and constitutes another side surface of the beam. Here, the side plate part 3 also serves as a wall surface of the lower half part 1 of the external compartment. Note that the side plate part 3 is a member provided in the direction parallel to the turbine axis direction.

Further, beam portions in another direction orthogonal to the beam members in the one direction each include: a bottom surface part (not illustrated) similarly to the above; an end plate part 4 that constitutes one side surface of the beam; and a side surface part 16 that is opposed to the end plate part 4 and constitutes another side surface of the beam as illustrated in FIG. 2. Here, the end plate part 4 also serves as a wall surface of the lower half part 1 of the external compartment. Note that the end plate part 4 is a member provided in the direction perpendicular to the turbine axis direction.

Note that diaphragms 14 and studs 15 may be provided inside of each beam portion. The diaphragms 14 are plate-like members provided perpendicularly to the axis direction of the beam portion, and enhance the rigidity of the beam portion. The studs 15 are members such as bolts that are welded to the side plate part 3 and the end plate part 4 made of steel plates, and the steel plates and the concrete 13 are integrated with each other by providing the studs 15 inside of the beam member.

The outer wall of the side surface portion of the external compartment is formed of the side plate part 3 and the end plate part 4. Then, internal reinforcement ribs 5 and 8 and an internal reinforcement stay bar 9 are provided as an internal structure in the lower half part 1.

As described above, according to the present invention, the side plate part 3 and the end plate part 4 of the external compartment are used in common to the side plates of the beam portions of the frame, and hence the frame doubles as a reinforcement member of the external compartment. The frame has a steel-plate reinforced concrete structure, and thus can secure strength high enough to prevent deformation due to a difference in pressure between the inside and the outside of the external compartment. As illustrated in FIGS. 8 to 11 according to the related art, in the case where an external compartment configurable as an independent single structure is placed inside of the frame 80, it is necessary to provide the T-rib 54 along the outer wall and provide the internal reinforcement rib 57 and the stay bar 58 inside. In contrast, according to the present invention, the reinforcement structure of the external compartment can be reduced compared with the related art. Hence, the number of members that hinder a flow of steam guided from the external compartment to a condenser can be reduced, and the discharge performance of the low-pressure turbine can be improved.

Next, description is given of placement of a turbine internal compartment in the case of using the frame and the turbine external compartment according to the present invention.

A turbine internal compartment 70 houses a rotor therein, and is placed inside of the turbine external compartment. The main body of the internal compartment 70 is supported on the internal reinforcement rib 5 by means of a flange 72 provided on the outer wall of the internal compartment 70. The flange 72 is a horizontal member that is provided so as to protrude from the outer wall of the internal compartment 70 and is parallel to the turbine axis direction. The internal reinforcement rib 5 is a plate-like member that is coupled to two side plate parts 3 and is provided therebetween. The internal reinforcement rib 5 reinforces the external compartment from the inside thereof, to thereby prevent deformation due to a difference in pressure between the inside and the outside thereof, and an upper part of the internal reinforcement rib 5 supports the internal compartment 70. An adjuster 6 is placed at the upper end of the internal reinforcement rib 5.

Figure 11:
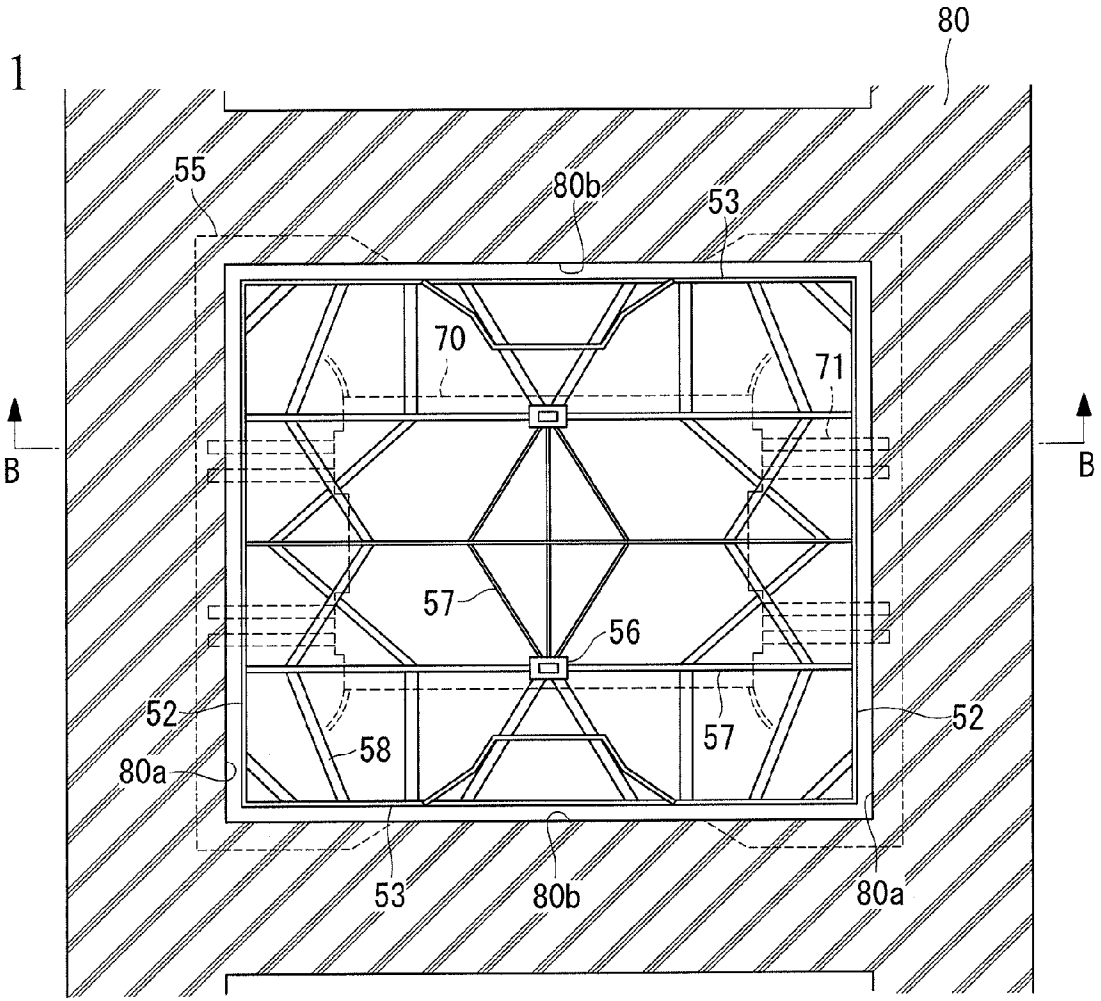
FIG. 11 is a plan view illustrating the frame and the lower half part of the turbine external compartment according to the related art.

As illustrated in FIG. 11, the main body of the internal compartment 70 according to the related art is supported on the frame 80 by means of a support member 71 provided on the outer wall of the internal compartment 70, and is built in the external compartment. Further, the internal reinforcement rib 57 according to the related art does not support the internal compartment 70, and merely reinforces the external compartment from the inside thereof. In contrast, according to the present invention illustrated in FIG. 1 and FIG. 2, the internal reinforcement rib 5 serves for both the reinforcement of the external compartment and the support of the internal compartment 70. Accordingly, the present invention does not require the support member 71 provided on the outer wall of the internal compartment, which is required by the related art, so that the support structure of the internal compartment 70 is simplified. Hence, the number of members that hinder a flow of steam guided from the external compartment to the condenser can be reduced, and the discharge performance of the low-pressure turbine can be improved.

Further, in the structure according to the related art, if the internal compartment 70 is put on the internal reinforcement rib 57, because a clearance is provided between the lower half part 50 and the beam side surfaces 80*a* and 80*b* of the frame 80 as illustrated in FIG. 11, the lower half part 50 is deformed by the weight of the internal compartment 70 and the like. Hence, the support point of the internal compartment 70 moves, and a problem arises in clearance management. In contrast, according to the present invention, the external compartment is integrated with the frame, and thereby the rigidity of the external compartment is improved. Hence, even if the internal compartment 70 is put on the internal reinforcement rib 5, the external compartment does not deform.

Still further, according to the related art, the internal compartment 70 is positioned on the basis of the external compartment having a flexible structure. In contrast, according to the present invention, because the external compartment hardly deforms even under the application of a vacuum load, the internal compartment 70 is positioned on the basis of the frame having a rigid structure with the intermediation of the internal reinforcement rib 5. As a result, the present invention can improve the positioning accuracy of the internal compartment.

Figure 3:
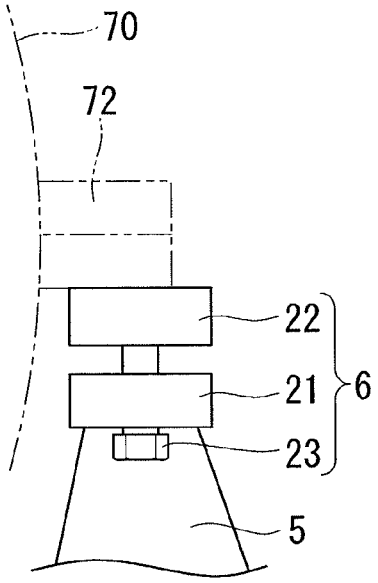
FIG. 3 is a side view illustrating an adjuster according to the present invention.
Figure 4:
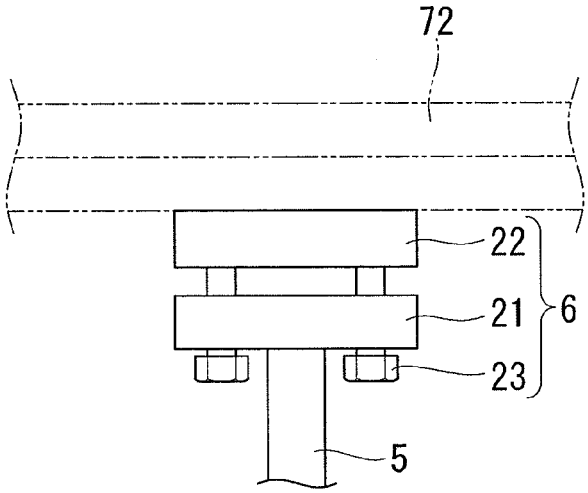
FIG. 4 is a side view illustrating the adjuster according to the present invention.

Note that the constructing accuracy of the frame having a steel reinforced concrete structure is inferior to the constructing accuracy of the internal compartment 70, and hence the present invention requires position adjustment using the adjuster 6. The adjuster 6 is placed only below the flange 72 provided on the outer wall of the internal compartment 70. The adjuster 6 is described with reference to FIG. 3 and FIG. 4. FIG. 3 and FIG. 4 are side views each illustrating the adjuster according to the present invention. FIG. 3 is a view taken in the direction parallel to the turbine axis direction, and FIG. 4 is a view taken in the direction perpendicular to the turbine axis direction.

The adjuster 6 includes, for example, a rectangular parallelepiped support member 21, a rectangular parallelepiped vertically movable member 22, and bolts 23. The support member 21 is placed on the internal reinforcement rib 21, and bolt holes through which the bolts 23 respectively penetrate are formed in the support member 21. An end part of each bolt 23 is fixed to the vertically movable member 22. Then, the position of the vertically movable member 22 can be moved up and down by tightening and loosening the bolts 23. The flange 72 of the internal compartment 70 is put on the vertically movable member 22, whereby the adjuster 6 can adjust the position of the internal compartment 70 in the vertical direction.

According to the present invention, almost no thermal expansion due to a rise in temperature during operation occurs in the external compartment. In contrast, thermal expansion in the axis direction occurs in the rotor in the internal compartment 70. Hence, a difference in thermal expansion between the external compartment and the rotor in the internal compartment 70 becomes larger in the turbine axis direction, resulting in difficulty in clearance management. According to the related art, a positioning key 56 for positioning provided in the middle of the internal reinforcement rib 57 is used for the internal compartment 70. In contrast, according to the present invention, because it is necessary to thermally expand the internal compartment 70 in order to reduce an influence of a difference in thermal expansion in the axis direction between the external compartment and the rotor in the internal compartment 70, a positioning key for positioning of the internal compartment 70 is not provided. That is, according to the present invention, in principle, the internal reinforcement rib 5 and the internal compartment 70 do not come into contact with each other.

Figure 5:
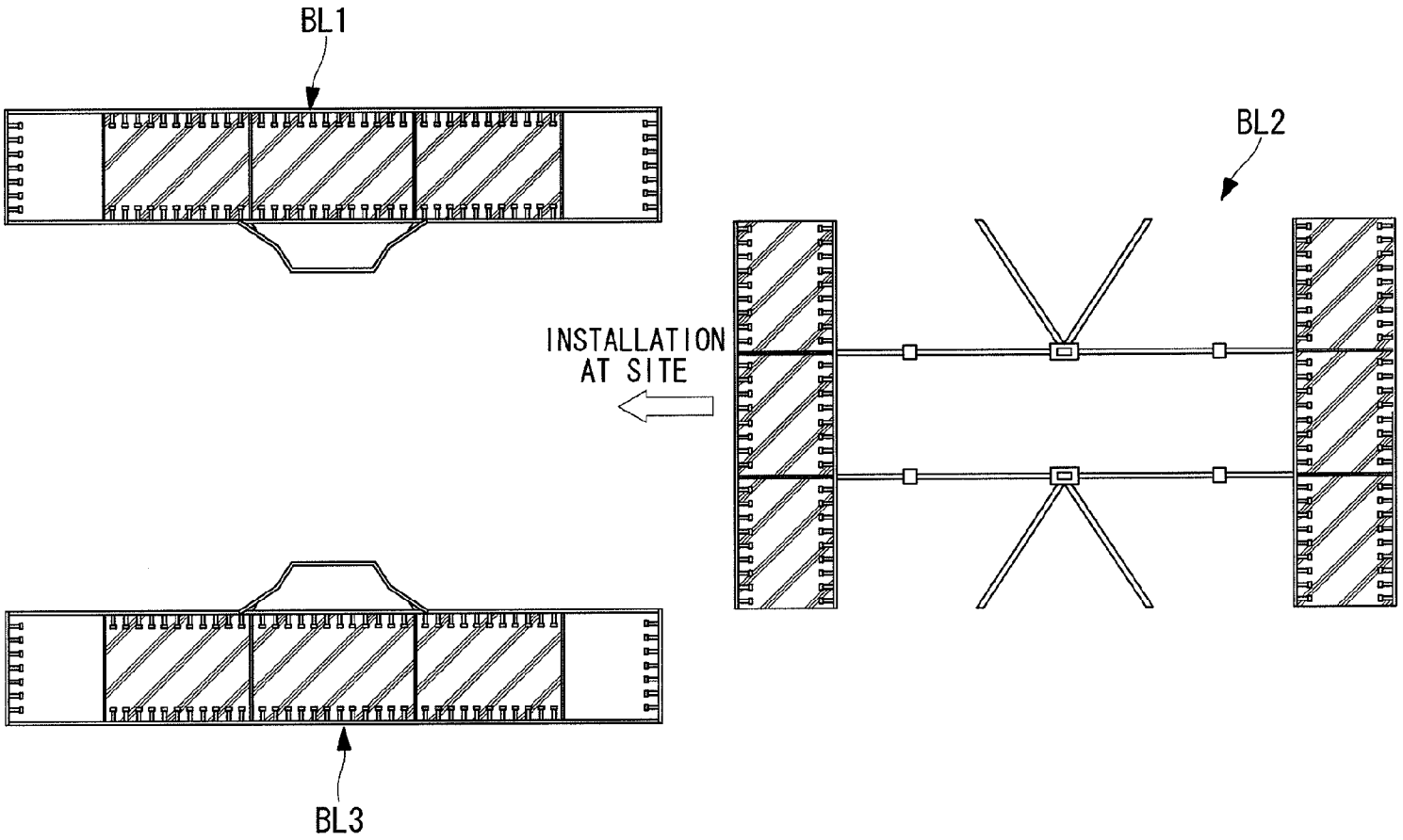
FIG. 5 is a schematic view illustrating one step of a method of constructing the frame and the turbine external compartment according to the present invention.
Figure 6:
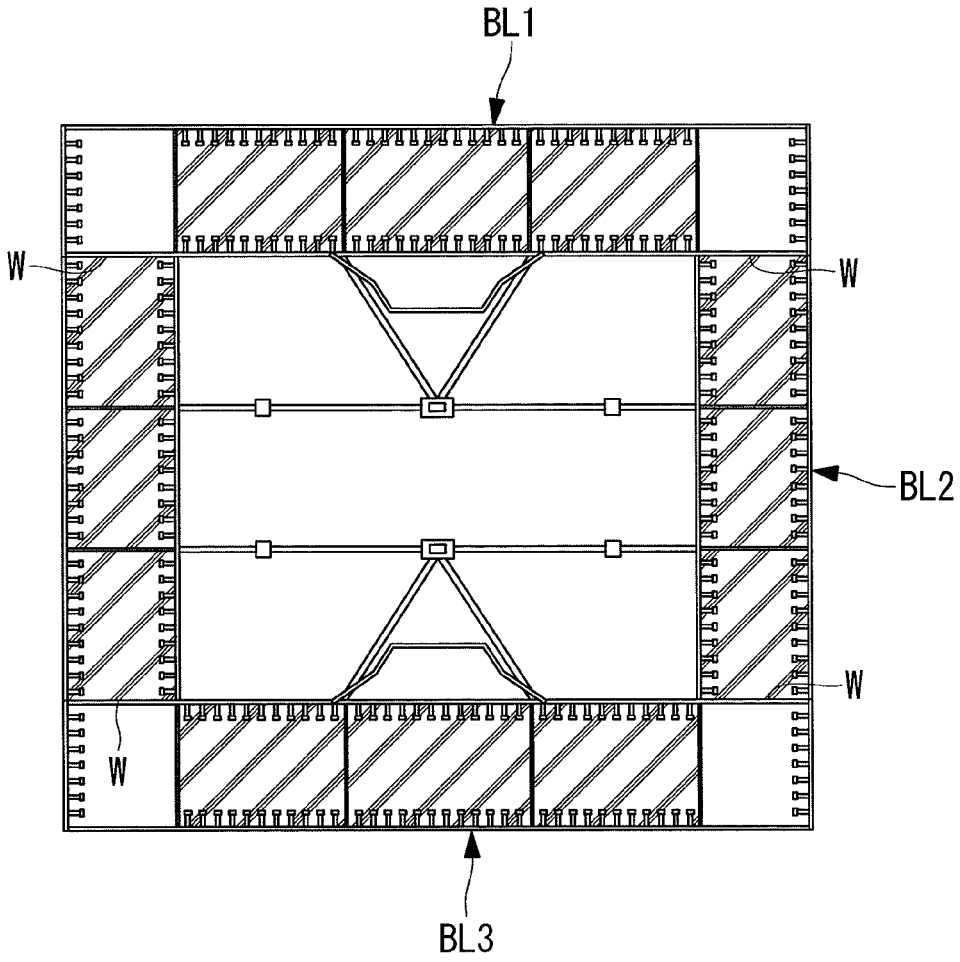
FIG. 6 is a schematic view illustrating one step of the method of constructing the frame and the turbine external compartment according to the present invention.
Figure 7:
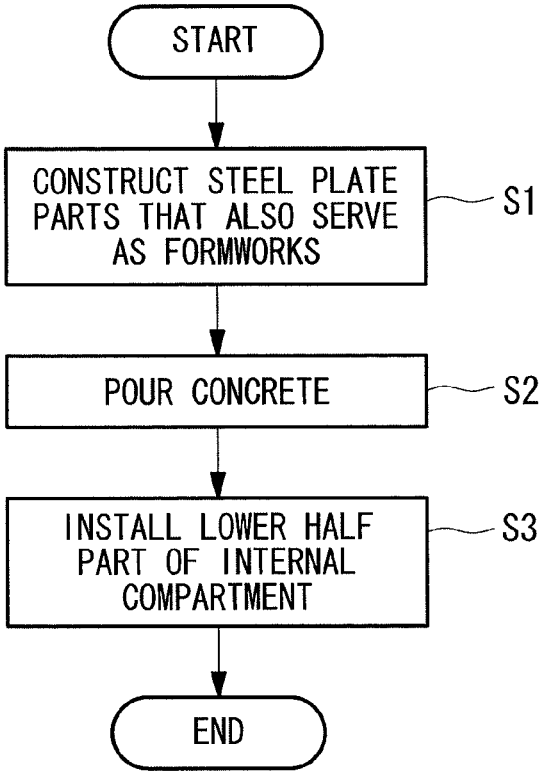
FIG. 7 is a flow chart illustrating the method of constructing the frame and the turbine external compartment according to the present invention.

Next, a method of constructing the frame and the turbine external compartment according to the present invention is described. FIG. 5 is a schematic view illustrating one step of the method of constructing the frame and the turbine external compartment according to the present invention, and illustrates carry-in of steel blocks and installation thereof at the site. Similar to FIG. 5, FIG. 6 is a schematic view illustrating one step of the method of constructing the frame and the turbine external compartment according to the present invention, and illustrates connection between the steel blocks. FIG. 7 is a flow chart illustrating the method of constructing the frame and the turbine external compartment according to the present invention.

According to the present invention, the frame 80 has a steel reinforced concrete structure rather than a general reinforced concrete structure, and hence formwork construction for concrete pouring is not necessary. As a result, the work period of a turbine building including the frame can be shortened. Further, because the frame and the lower half part of the turbine external compartment are integrated with each other, the outer wall of the lower half part is constructed by constructing the frame. Hence, a step of constructing the lower half part at the site can be reduced.

According to the present invention, as illustrated in FIG. 5, steel blocks BL1, BL2, and BL3 are constructed in advance in a factory or the like. The steel blocks BL1, BL2, and BL3 also serve as formworks for concrete. Note that the diaphragms 14 and the studs 15 are placed in advance inside of the steel blocks BL1, BL2, and BL3, and thereby the construction period at the site of building construction can be shortened. The steel blocks BL1 and BL3 each include: a beam member including the end plate part 4; pillar members respectively located at both ends of the beam member; and a bearing part 21. The steel block BL2 includes: two beam members each including the side plate part 3; and the internal reinforcement structure (the internal reinforcement ribs 5 and 8 and the internal reinforcement stay bar 9) placed between the beam members.

Then, the steel blocks BL1, BL2, and BL3 are carried from the factory to the site, and are placed at the site (Step S1). At this time, as illustrated in FIG. 6, the steel block BL1 and the steel block BL2 are welded to each other, and the steel block BL2 and the steel block BL3 are welded to each other, and thereby the frame can be integrally constructed. The reference signs W in FIG. 6 each denote a welded portion.

After that, concrete is poured into between the steel plates of the steel blocks BL1, BL2, and BL3 at the site (Step S2). Then, after the concrete pouring, the lower half part of the internal compartment is installed in the external compartment (Step S3). Note that positioning adjustment is performed using the adjuster 6, in order to secure the installation accuracy of the internal compartment.

Figure 12:
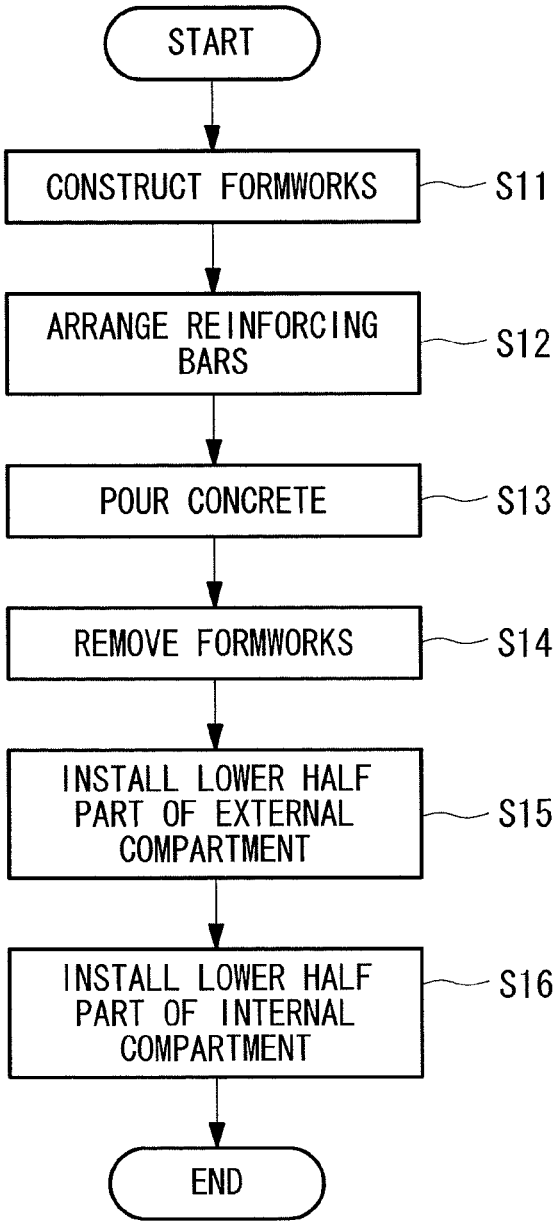
FIG. 12 is a flow chart illustrating a method of constructing the frame and the turbine external compartment according to the related art.

Meanwhile, the frame having a reinforced concrete structure according to the related art is constructed through such steps as illustrated in FIG. 12. FIG. 12 is a flow chart illustrating a method of constructing the frame and the turbine external compartment according to the related art.

That is, first, scaffolding is set up by scaffolding construction, and formworks are then constructed (Step S11). Then, reinforcing bars are arranged in the formworks (Step S12).

After that, concrete is poured into the formworks in which the reinforcing bars are arranged (Step S13). Lastly, the formworks are removed after the elapse of a curing period during which the concrete hardens (Step S14). Through the steps described above, the frame having a reinforced concrete structure according to the related art is constructed.

Then, the lower half part 50 of the external compartment is installed in an opening in an upper part of the completed frame (Step S15). Next, the lower half part of the internal compartment 70 is installed in the lower half part 50 of the external compartment (Step S16).

In contrast to the above-mentioned constructing method according to the related art, according to the present invention, the steel blocks BL1, BL2, and BL3 are first constructed in the factory, and thereby the construction period at the site can be shortened. Further, the constructing accuracy of the frame can be improved by constructing in the factory. Note that, if installation of the steel blocks BL1, BL2, and BL3 at the site can be simplified, scaffolding construction necessary for formwork construction can also be omitted.

Further, because the frame according to the present invention has a steel-plate reinforced concrete structure rather than a general reinforced concrete structure, reinforcing bar arrangement at the site is not necessary. Further, the waiting time that is required for concrete hardening from concrete pouring to formwork removal can be reduced. Accordingly, the present invention can shorten the work period compared with the related art.

Still further, according to the present invention, the frame and the outer wall of the external compartment are used in common, and hence no clearance exists between the frame and the outer wall of the external compartment. Accordingly, in the case where the size of the external compartment is assumed to be the same between the related art and the present invention, the size of the frame according to the present invention is smaller, so that the amount of poured concrete can be reduced. Further, the frame having a reinforced concrete structure according to the related art requires cover concrete in order to sufficiently cover the reinforcing bars. In contrast, according to the present invention, such cover concrete can be reduced, and hence the amount of poured concrete can also be reduced.

Then, according to the present invention, like the steel block BL2, the beam members and the internal reinforcement members are integrated with each other, and the integrated structure is installed at the site. Hence, like the frame having a reinforced concrete structure according to the related art, a step of separately installing the external compartment is not necessary.

As described above, in recent years, along with an increase in the size of turbines, it is becoming difficult to secure the rigidity necessary for a compartment. Under the circumstances, according to the present invention, the outer wall of the turbine external compartment and the side surface parts of the beams of the frame having a steel-plate reinforced concrete structure are used in common. As a result, the external reinforcement of the external compartment is not necessary, an increase in size of the external reinforcement of the external compartment, which is required by the related art, is not necessary, and the external compartment can be efficiently reinforced. Further, the reinforcement structure inside of the external compartment can be reduced, and hence the discharge performance from the inside of the external compartment to the condenser can be improved compared with the related art.

Further, according to the method of constructing the frame and the turbine external compartment, the beam members of the frame are integrated with the outer wall of the external compartment and the internal reinforcement members. Hence, installation of the external compartment at the site is not necessary, and the construction period at the site can be shortened. Further, the steel blocks in which the frame and the external compartment are integrated with each other are constructed in the factory, and hence the accuracy of dimension of the external compartment can be improved.

Note that FIG. 5 and FIG. 6 each illustrate the example in which the frame is divided into three steel blocks, and the three divided steel blocks are constructed, but the present invention is not limited to this example. The number of steel blocks may be equal to or less than two and may be equal to or more than four in accordance with the size of the frame, construction procedures, the weight limit of a crane, and the like. If an integrated frame having such a non-divided shape as illustrated in FIG. 6 can be carried from the factory to be installed at the site, the accuracy of dimension can be further improved compared with the example with divided blocks.

Further, description is given above of the method of constructing the frame and the turbine external compartment according to the present invention with the use of the steel blocks, but the present invention is not limited to this example. For example, a steel frame and a turbine external compartment may be constructed separately from each other, and the external compartment may be inserted into the frame without any clearance, and thereby the outer wall of the external compartment and the side plate parts or the end plate parts of the frame may be integrated with each other. Even in this case, similar to the frame and the turbine external compartment described above, a flow of steam inside of the compartment can be improved, and the rigidity of the compartment can be enhanced using a simple structure.

REFERENCE SIGNS LIST

1 lower half part
2 upper half part
3 side plate part
4 end plate part
5, 8 internal reinforcement rib
6 adjuster
9 internal reinforcement stay bar
12, 16 side surface part
13 concrete
14 diaphragm
15 stud
70 internal compartment

The invention claimed is:

1. A turbine external compartment that is placed in a frame having a steel-plate reinforced concrete structure obtained by filling a space between a plurality of steel plates with concrete, the turbine external compartment comprising:

a lower half part having a pair of side plates and a pair of end plates; and an internal reinforcement rib having an upper part for supporting a turbine internal compartment, wherein the internal reinforcement rib is provided between the pair of side plates, wherein at least one of the pair of side plates and the pair of end plates are made of the steel plates of the frame, and wherein the internal reinforcement rib is coupled to the pair of side plates.

2. The turbine external compartment according to claim 1, further comprising:

an adjustment member provided on the internal reinforcement rib, for adjusting a vertical position of the turbine internal compartment.

* * * * *